US007162169B1

(12) United States Patent
Lestrange

(10) Patent No.: US 7,162,169 B1
(45) Date of Patent: Jan. 9, 2007

(54) CONTROL SYSTEM AND METHOD FOR MITIGATING TRANSIENTS IN A MACHINE DUE TO OCCASIONAL MAINTENANCE OR SERVICE

(75) Inventor: Jack T Lestrange, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/289,722

(22) Filed: Nov. 30, 2005

Related U.S. Application Data

(63) Continuation-in-part of application No. 11/169,756, filed on Jun. 30, 2005, now Pat. No. 7,123,850.

(51) Int. Cl.
*G03G 15/00* (2006.01)

(52) U.S. Cl. ..... 399/46; 399/9

(58) Field of Classification Search ..... 399/9, 399/11, 43, 46
See application file for complete search history.

(56) References Cited

U.S. PATENT DOCUMENTS 5,471,313 A 11/1995 Thieret et al.
5,708,916 A * 1/1998 Mestha ..... 399/46 X
5,717,978 A * 2/1998 Mestha ..... 399/46
5,749,019 A * 5/1998 Mestha ..... 399/46
5,749,021 A * 5/1998 Mestha et al. ..... 399/46 X
6,198,886 B1 * 3/2001 Brewington ..... 399/46 X
6,771,912 B1 * 8/2004 Mo et al. ..... 399/46
2005/0095024 A1 5/2005 Gross et al.

* cited by examiner

*Primary Examiner*—Sandra L. Brase
(74) *Attorney, Agent, or Firm*—Oliff & Berridge, PLC

(57) ABSTRACT

A control system and method of predicting how a machine will respond to occasional or periodic service, and adjusting the machine accordingly to account for the change in machine behavior due to the service, mitigates transients in machine performance. A prediction of the service effect is fed forward to the existing control system just prior to the occurrence of service in order to compensate for the service effect. This prediction is continually updated and refined using subsequent measurements of the effect of service on machine performance. More specifically, a controller monitors the process output variables indicative of the machine performance and adjusts machine inputs to achieve a desired level of machine performance. The controller monitors the process output variables indicative of the machine performance prior to, during, and immediately after the service and adjusts the machine inputs to compensate for the transients.

17 Claims, 10 Drawing Sheets

CONTROL SYSTEM AND METHOD FOR MITIGATING TRANSIENTS IN A MACHINE DUE TO OCCASIONAL MAINTENANCE OR SERVICE

This is a continuation-in-part application of U.S. application Ser. No. 11/169,756 filed on Jun. 30, 2005 now U.S. Pat. No. 7,123,850, which is hereby incorporated by reference in its entirety.

BACKGROUND

The exemplary embodiments are directed to a machine or process that is subject to periodic or occasional maintenance or service.

The related art includes machines, such as, for example, a copier, a printer, or the like that are under a closed-loop feedback control. If a machine is subject to occasional or periodic maintenance or service, the effect of the maintenance or service may change the machine and/or the control process of the machine. Such maintenance or service may include cleaning, repair, part replacement, or the like. A change to the machine due to maintenance can have a large impact on the machine response and hence the closed-loop behavior of the system. For example, under closed-loop control, the machine inputs may be at certain values in order to keep machine performance on target, and the values for the machine inputs required prior to maintenance may be different from the values required after maintenance.

For example, in the related art, there is an on-line process for cleaning donor rolls and wires in the Hybrid Scavengeless Development (HSD) subsystem of an imaging device, known as Vdm blip. This process involves periodically reversing a bias on the donor rolls with respect to the voltage on the magnetic roll while maintaining a nominal wire voltage waveform. This approach electrostatically cleans the donor rolls by developing the toner from the donor rolls back onto a magnetic roll, and results in the wires scrubbing against the donor rolls, further aiding the cleaning process. See, for example, U.S. Patent Publication No. 20050095024, hereby incorporated by reference in its entirety.

This on-line cleaning process was implemented on a xerographic printer where it was demonstrated that periodic donor roll and wire cleaning leads to a large improvement in toner life. However, this cleaning process may interact with existing xerographic process controls, such as the process controls described in, for example, U.S. Pat. No. 5,471,313, hereby incorporated by reference in its entirety. This interaction may cause the developed toner mass per unit area (DMA) to temporarily deviate from a predetermined target value. This interaction comes about because after the cleaning process, developability is enhanced such that relatively small process control actuator values are required to meet the DMA target. Existing process controls are not aware of this sudden change in developability, and, as a result, after the cleaning process the existing process controls use actuator values that are too large to meet the DMA target. Subsequent to the cleaning process, the existing process controls observe deviations in the measured DMA and adjust the actuator values in order to bring DMA back on target. The problem is that color shifts are observed in images as the process controls readjust to the new developability state. Furthermore, the time it takes for the machine or system to return to a steady state indicates the significance of machine transients that occur during maintenance. Thus, this on-line cleaning process was subsequently eliminated as a means of improving toner life, in large part because of the DMA transients.

SUMMARY

In accordance with the exemplary embodiments, in a machine under closed-loop control subject to occasional maintenance, where maintenance results in transients in machine performance, to mitigate transients in machine performance due to maintenance, a prediction of the maintenance effect is fed forward to the existing control system just prior to the occurrence of maintenance in order to compensate for the maintenance effect. This prediction is continually updated and refined using subsequent measurements of the effect of maintenance on machine performance.

The exemplary embodiments predict how the machine will respond to maintenance, feed this prediction forward to process controls to make adjustments just prior to the maintenance cycle, and update or adapt the prediction of adjustments needed for the next maintenance cycle to correct for transients following the next maintenance cycle, based on both the current and past performance immediately following the maintenance cycle. Thus, by anticipating the effect maintenance may have on a machine instead of only reacting to it, the benefits of the maintenance can be realized without the expense of transient deviations from target.

In other words, the process controls of a machine may view maintenance as a disturbance and the machine output may significantly deviate from target as the process controls readjust to the machine post-maintenance. Accordingly, the machine may need to be down until the transients subside, and if the maintenance is frequent enough, the machine efficiency may be severely impacted.

For example, a machine, such as a copier, printer, or the like, will have output. The output these types of machines produce, i.e., color copies, printed document, or the like, are expected to have a desired value. The values may include ink adherence, color uniformity, color accuracy, or any other image quality attribute. In controlling the quality of the output, a process controller, including sensing or measurement devices and actuation devices, manipulates variables in an attempt to achieve acceptable output quality. The actuators may be voltages, motor speeds, rate at which toner is dispensed, and like adjustments that may be made within the machine. The controller may take an input of the measurements and may provide the new settings for the actuators. For example, voltages in the machine, speed of motors of the machine, or the like, may be adjusted to achieve a better quality output or optimum output. The machine variables are thus adjusted to achieve a customer desired image quality.

The variables of the machine may be adjusted by taking measurements in the machine to determine how well the machine is performing, and then based on those measurements, actuators may be adjusted so that a measured performance equals the customer-desired performance. A controller controls the adjustment mechanism. The controller may be a set of algorithms that take as input the measurement readings. The algorithms may provide an output of new settings for the actuators. This process may occur in real time and may occur repeatedly.

Thus, in one exemplary embodiment, the machine is constantly correcting itself. In another exemplary embodiment, a user may be provided with the variable measurements and the user may then adjust the machine.

Accordingly, with a machine that periodically produces output, the output may be measured by a customer print or by internal machine test patterns that the machine produces automatically. The measurements may be compared to a reference value. If the measurement and its respective reference value deviate by a specific or predetermined amount, then the machine will automatically adjust the actuators in such a way as to make the measured values approach the reference value, i.e., the target value.

When maintenance is performed on a machine, the variable settings of the machine may be affected, as discussed above. Thus, the measurements collected by the controller may no longer apply and the image quality of the output may thus not be optimal, desirable, or that which was expected.

Any changes to the machine due to, for example, maintenance, may eventually be adjusted when the process controls take measurements and realize that adjustments to the variables again are needed to bring the system, or machine, back on target. However, there is a delay before the system or machine is back on target. Such delays may cause a customer to have to wait for the machine to get back on line, or may cause the machine to shut down temporarily, which causes a loss in productivity.

The exemplary embodiments address this delay, in that, if maintenance cycles are known, and it is known how the maintenance cycles impact the process control, this knowledge of how the system is affected by the maintenance cycles may be built into the process controls.

In an exemplary embodiment, a control system for mitigating transients in machine performance due to periodic or occasional maintenance action taken on a machine, wherein the machine performance is evaluated based on process output variables includes a first controller and a second controller. The first controller monitors the process output variables indicative of the machine performance and adjusts machine inputs to achieve a desired level of machine performance. The second controller monitors the process output variables indicative of the machine performance prior to, during, and immediately after the periodic or occasional maintenance action and adjusts the machine inputs to compensate for the transients in machine performance due to the maintenance action.

The first controller and the second controller send signals to adjust the machine inputs based on the monitored process output variables indicative of the machine performance. The first controller adjusts the machine inputs for transients introduced by routine variation of the machine and the second controller adjusts the machine inputs for transients introduced by the periodic or occasional maintenance action taken on the machine. The second controller augments the signal from the first controller to compensate for the transient induced by the occasional or periodic maintenance action and predicts the necessary machine inputs to compensate for the transients in machine performance due to the occasional or periodic maintenance action.

The second controller also has an algorithm and a model. The algorithm uses measurements of machine performance obtained prior to, during, and immediately after the maintenance action to update the prediction of the necessary machine inputs to compensate for the transients in machine performance. The model is for transients in machine performance affected as a result of the occasional or periodic maintenance action.

Furthermore, both a current performance of the machine and a past performance of the machine are measured by the second controller after the occasional or periodic maintenance action and the second controller predicts how the machine will respond to the occasional or periodic maintenance action.

In another exemplary embodiment, a method for mitigating transients in machine performance due to periodic or occasional maintenance action taken on a machine includes: evaluating the machine performance based on process output variables; monitoring the process output variables indicative of the machine performance with a first controller; adjusting machine, inputs to achieve a desired level of machine performance with the first controller; monitoring the process output variables indicative of the machine performance prior to, during, and immediately after the periodic or occasional maintenance action with a second controller; and adjusting the machine inputs with the second controller to compensate for the transients in machine performance due to the maintenance action.

This method for mitigating transients in machine performance due to periodic or occasional maintenance action also includes sending signals with the first controller and the second controller to adjust the machine inputs based on the monitored process output variables indicative of the machine performance; adjusting the machine inputs with the first controller to account for the transients introduced by a routine variation of the machine; adjusting with the second controller the machine inputs for the transients introduced by the periodic or occasional maintenance action taken on the machine; augmenting the signal from the first controller with the second controller, wherein the signal from the first controller is augmented to compensate for the transient induced by the occasional or periodic maintenance action; and predicting, with the second controller, the necessary machine inputs to compensate for the transients in machine performance due to the occasional or periodic maintenance action.

This method for mitigating transients in machine performance due to periodic or occasional maintenance action further includes updating the prediction of necessary machine inputs to compensate for the transients in the machine performance, wherein the second controller has an algorithm that uses measurements of the machine performance obtained prior to, during, and immediately after the maintenance action to update the prediction of the necessary machine; measuring with the second controller both a current performance of the machine and a past performance of the machine after the occasional or periodic maintenance action; and predicting, with the second controller, how the machine will respond to the occasional or periodic maintenance action. The second controller has a model for transients in the machine performance that is affected as a result of the occasional or periodic maintenance action.

In another exemplary embodiment, a control system for mitigating transients in machine performance due to periodic or occasional maintenance action taken on a machine includes: means for evaluating the machine performance based on process output variables; means for monitoring the process output variables indicative of the machine performance and for adjusting machine inputs to achieve a desired level of machine performance; and means for monitoring the process output variables indicative of the machine performance prior to, during, and immediately after the periodic or occasional maintenance action, and for adjusting the machine inputs to compensate for the transients in machine performance due to the maintenance action.

In another exemplary embodiment, a control system for mitigating transients in machine performance due to periodic or occasional maintenance action taken on a machine, wherein the machine performance is evaluated based on process output variables, includes a single controller or a plurality of controllers that monitors the process output variables indicative of the machine performance and adjusts machine inputs, including magnetic roll bias, charged and recharged bias and ROS intensity, to achieve a desired level of machine performance. The controller also monitors the process output variables indicative of the machine performance prior to, during, and immediately after the periodic or occasional maintenance action and adjusts the machine inputs to compensate for the transients in machine performance due to the maintenance action, the second controller operating under a cycle-up convergence mode and a maintenance mode.

The controller operates such that, in the cycle-up convergence mode, the controller completes several iterations at a cycle-up, allowing xerographic setpoint/Vdm blip transient mitigation convergence. The controller also operates such that, at the cycle-up, the controller analyzes a post-blip DMA response with a constant Vmag and computes a DMA error as a function of time from blip occurrence, wherein the DMA error is an actual measurement of the DMA subtracted by a setpoint DMA. The controller further operates such that, after a Vdm blip routine, the controller varies the Vmag to mitigate DMA transients induced by the blip routine. Furthermore, the controller operates such that, during cycle-up convergence, after DMA has converged, the controller compensates for mid and low density patch transients; varies Vcharge and ROS intensity to mitigate TRC variations included by the Vdm blip cycle; updates Vcharge and ROS intensity between blip cycles. In a maintenance mode, the controller periodically adjusts Vdm Blip compensations to maintain xerographic set-point targets.

In yet another exemplary embodiment, a method for mitigating transients in machine performance due to periodic or occasional maintenance action taken on a machine, wherein the machine performance is evaluated based on process output variables, includes: monitoring the process output variables indicative of the machine performance with a first controller; adjusting machine inputs to achieve a desired level of machine performance with the first controller; monitoring the process output variables indicative of the machine performance prior to, during, and immediately after the periodic or occasional maintenance action with a controller; adjusting the machine inputs with the controller to compensate for the transients in machine performance due to the maintenance action; and operating the controller under a cycle-up convergence mode and a maintenance mode.

This method for mitigating transients in machine performance due to periodic or occasional maintenance action also includes completing several iterations at a cycle-up with the controller, allowing xerographic setpoint/Vdm blip transient mitigation convergence, when in the cycle-up convergence mode.

This method for mitigating transients in machine performance due to periodic or occasional maintenance action also includes analyzing with the controller a post-blip DMA response with a constant Vmag and computing a DMA error as a function of time from blip occurrence, wherein the DMA error is an actual measurement of the DMA subtracted by a setpoint DMA.

This method for mitigating transients in machine performance due to periodic or occasional maintenance action also includes varying the Vmag with the controller after a Vdm blip routine to mitigate DMA transients induced by the blip routine.

This method for mitigating transients in machine performance due to periodic or occasional maintenance action also includes compensating for the mid and low density patch transients after DMA has converged.

This method for mitigating transients in machine performance due to periodic or occasional maintenance action also includes varying Vcharge and ROS intensity with the controller to mitigate TRC variations included by the Vdm blip cycle, wherein Vcharge and ROS intensity are updated between blip cycles.

This method for mitigating transients in machine performance due to periodic or occasional maintenance action also includes periodically adjusting the Vdm Blip compensations in the maintenance mode, with the controller to maintain xerographic set-point targets.

In another exemplary embodiment, a control system for mitigating transients in machine performance due to periodic or occasional maintenance action taken on a machine, wherein the machine performance is evaluated based on process output variables, includes: means for monitoring the process output variables indicative of the machine performance; means for adjusting machine inputs to achieve a desired level of machine performance; means for monitoring the process output variables indicative of the machine performance prior to, during, and immediately after the periodic or occasional maintenance action; and means for adjusting the machine inputs to compensate for the transients in machine performance due to the maintenance action, operating under a cycle-up convergence mode and a maintenance mode.

DETAILED DESCRIPTION OF EMBODIMENTS

The exemplary embodiments are directed to a control system and method to keep a machine on target despite the effects of occasional or periodic maintenance. The control system includes an adaptive feedforward controller. The benefits of the process described herein include improved machine efficiency and enabling maintenance procedures that would not be possible otherwise because of the deleterious transient effects on machine performance due to maintenance. Following, with reference to FIG. 1, is a description of a general approach that may be applied to any machine or process subject to occasional or periodic maintenance.

Figure 1:
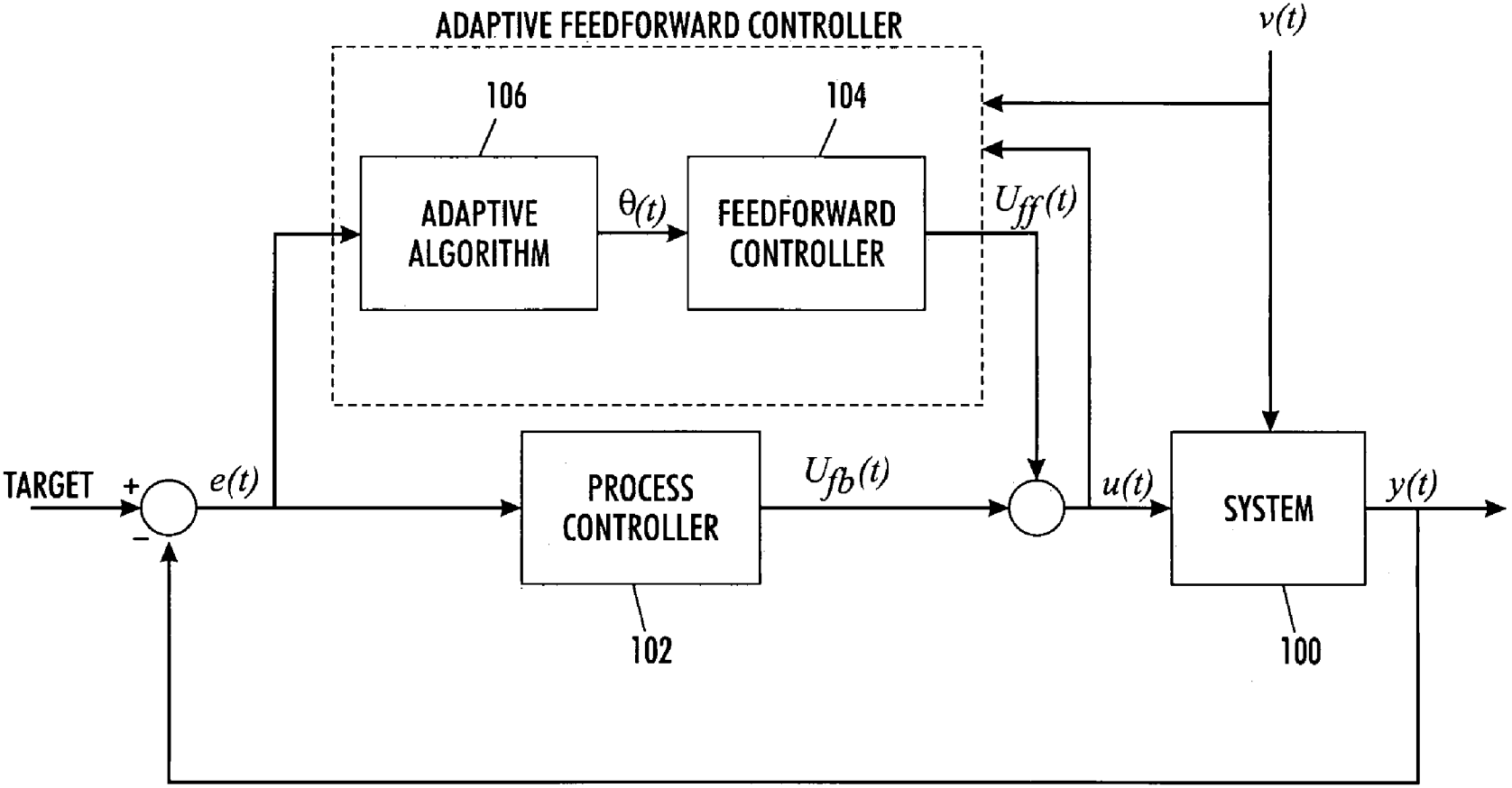
FIG. 1 is a block diagram illustrating an adaptive feedforward approach for mitigating machine transients due to maintenance in an exemplary embodiment.

Referring to FIG. 1, y denotes process measurements; u denotes process inputs (e.g., manipulated variables); v denotes maintenance actions; e refers to a tracking error (target−output); and θ refers to a set of controller parameters, which are adjusted or adapted to keep the machine on target. The overall input signals applied to the system are comprised of two parts: a feedback part, denoted by $u_{fb}$, that may be a vector and is derived from the existing process controls; and a feedforward part, denoted by $u_{ff}$, that may be a vector and is derived from the adaptive feedforward controller. The overall input signal may be constructed by either adding the feedback part ($u_{fb}$) and the feedforward component ($u_{ff}$) or, the input signal may be constructed by multiplying the feedback part ($u_{fb}$) and the feedforward component ($u_{ff}$), or the like.

The adaptive feedforward controller, in turn, has two pieces: a feedforward controller that includes a model for how the machine will respond to a maintenance cycle, and an adaptive algorithm that updates the feedforward controller and is designed to account for the fact that the machine response to maintenance may change over time. A sample model structure for predicting how the machine will respond to maintenance is given in Equation (1)

$$u_{ff}(t) = \sum_{i=1}^{M} f_i(\theta(t), u(t), v(t)), \tag{1}$$

where the $f_i$, i=1, . . . ,M, are given vector functions that map the parameters, θ, the previous values used for the process inputs, u, and the maintenance actions, v, into the feedforward prediction, $u_{ff}$. Typical choices for the functions, $f_i$, may include exponential, polynomial, trigonometric (e.g. sine or cosine), combinations thereof, or the like.

Referring to FIG. 1, a schematic block diagram of an adaptive feedforward approach for mitigating transients due to maintenance is illustrated. Here, a system 100 may be subject to variables including the process measurements y, process inputs u, and maintenance actions v. Each of these variables may be a vector including a number of different components. For example, the process measurements y may include the current measurements of the machine; the process inputs u may include variables that are modifiable such as, for example, voltages in the machine, speed of motors in the machine, or the like; and the maintenance actions v may include the maintenance that is applied to the system, for example, cleaning the machine, replacing parts in the machine, repairing parts in the machine, and/or manipulating variables in the machine, in an attempt to achieve acceptable output quality. Maintenance could occur while the machine is off-line, or maintenance could be performed in real-time while the machine is operational.

A process controller 102 considers the difference between measured values taken from the output of the machine and the target values, i.e., the tracking error e and then modifies the process inputs u accordingly. The process controller 102 thus will respond to variations in the machine and will make necessary adjustments to provide a desired output. For example, in a color printer, the output from the color printer has a desired image quality. If the color printer machine is not meeting target criteria, for example, color accuracy, the controller may adjust the developer roll voltage, or any other variable of the machine that would be appropriate to produce the desired image quality.

In a case where maintenance is performed on the machine, for example, cleaning, variations in the machine may occur. For example, if the donor rolls and wires in a printer based on HSD technology are cleaned, the required or necessary voltage applied to the magnetic developer roll to maintain a desired DMA value, or target, prior to cleaning is different than the necessary or required voltage applied to the magnetic developer roll after the cleaning. The process controller 102 will eventually, given enough time, account for the cleaning, and make any necessary adjustments to the machine. However, the time that it takes the process controller to respond to the system changing due to this variation is unacceptable because during this time period, less than a desired output may be produced. If the process controller 102 is not aware that maintenance is being performed on the machine, then the process controller 102 cannot timely address the need for changes to the machine.

A feedforward controller 104 is thus provided to include a model for how the machine will respond to a maintenance cycle. An adaptive algorithm 106 updates the feedforward controller 104 over time to account for changes in maintenance cycles.

Both the process controller 102 and the feedforward controller 104 provide signals to the system 100 in order to achieve a desired output. In other words, the exemplary embodiments provide a control system including two controllers: the process controller 102 which maintains specific actuator inputs of the machine to provide a desired output, and a feedforward controller that adjusts the actuator inputs of the machine that are affected due to maintenance of the machine.

Following are examples illustrating the control system and method discussed above.

SPECIFIC EXAMPLE—1

A concept of adaptive feedforward control is applied to a problem of mitigating developed mass transients resulting from interactions between periodic donor roll and wire maintenance and electrostatic process controls, as described above. Most of the analyses and experiments presented below may be easily generalized to other fixtures.

First Fixture

A first fixture may include a single hybrid scavengeless development housing that is capable of solid area development. An enhanced toner area coverage sensor is used to measure developed patches, e.g., patches of toner that have been deposited on and affixed to a substrate, in-situ and in real-time. For a sample printer, electrostatic process controls use three actuators, a magnetic roll voltage, a laser power, and a charge level on the photoreceptor, to control three targets along a tone reproduction curve. Since the first fixture is only a solid area development fixture, the analogue to the electrostatic process controls used on the sample printer consists of controlling the solid area development using the magnetic roll voltage (Vmag) as an actuator. In addition to a closed-loop control, the first fixture also has closed-loop toner concentration control. The development and toner concentration controllers represent the baseline process controls for the first fixture. Both controllers are standard proportional-integral (PI) type controllers with appropriately chosen gains.

A donor roll and wire maintenance cleaning process referred to as Vdm blip was implemented on the first fixture. This process involves periodically reversing a bias voltage on the donor rolls with respect to the voltage on the magnetic roll while maintaining a nominal wire voltage waveform (hence the term Vdm blip for the reversal of voltage potential level, between the donor roll and magnetic roll to clean the HSD wires). This approach electrostatically cleans the donor rolls by developing the toner from the donor rolls back onto a magnetic roll, and results in the wires scrubbing against the donor rolls, further aiding the cleaning process.

Figure 2:
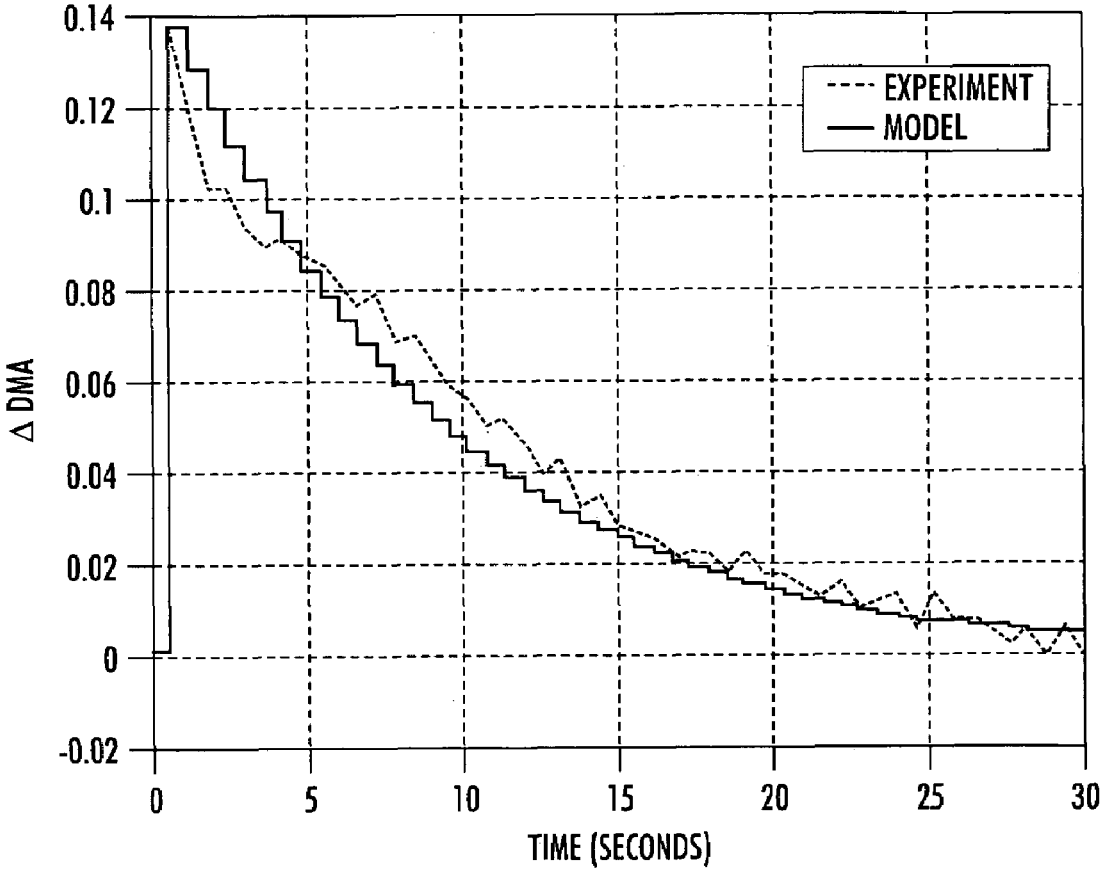
FIG. 2 is a chart of an open-loop DMA response to a single Vdm blip under low area coverage stress conditions in an exemplary embodiment.

FIG. 2 illustrates an open-loop DMA response to a single Vdm Blip under a particular set of printing conditions. In FIG. 2, the sharp rise in DMA occurs immediately after a Vdm blip followed by an exponential decay as the effect of the cleaning wears off. This pattern then repeats for each Vdm blip cycle. In initial experiments, the initial jump in DMA changed slowly over time as a function of toner age and environment. However, the decay time constant was relatively fixed. These open-loop observations serve as the basis for two control strategies described below.

Control Approach #1—Adaptive Feedforward Control

Figure 3:
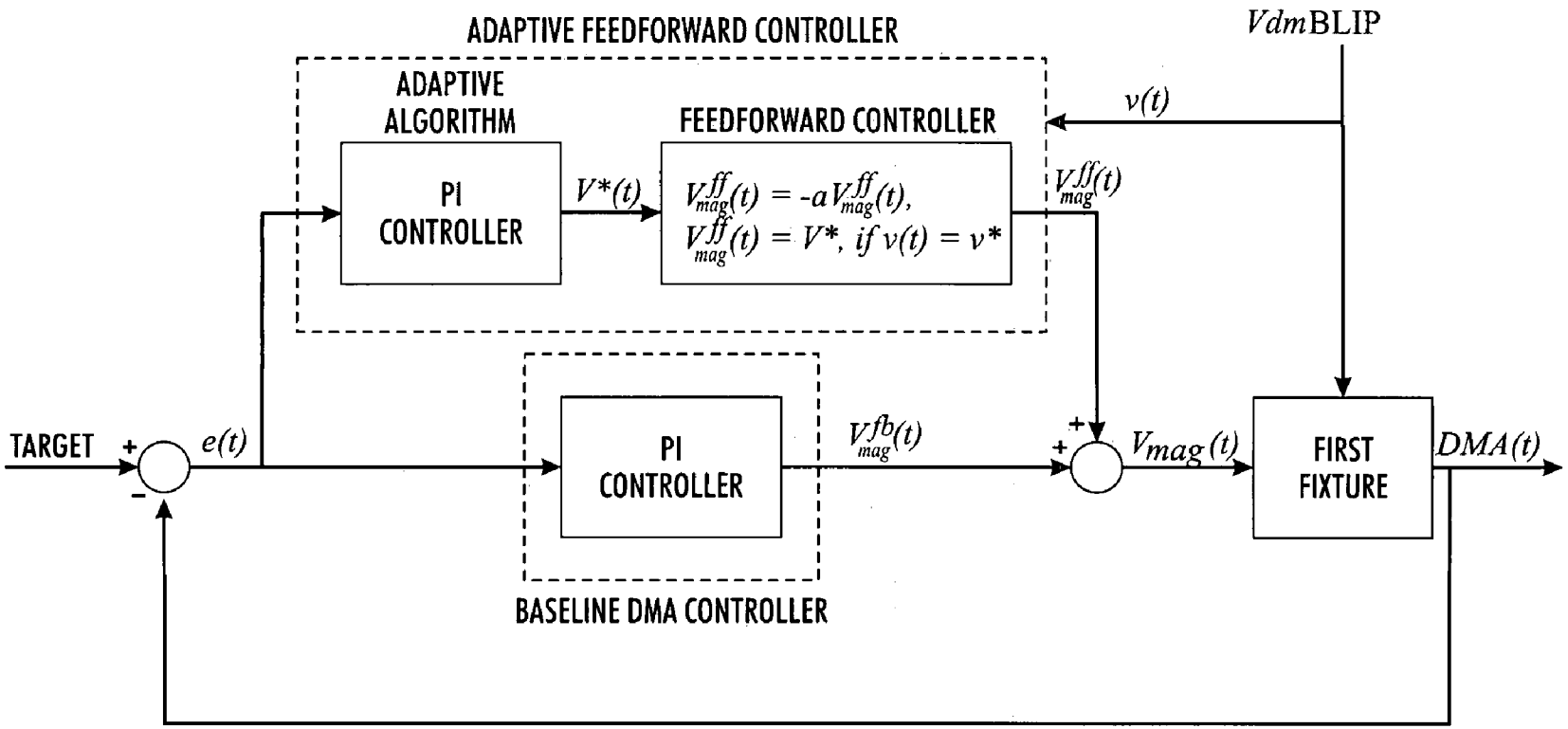
FIG. 3 is a block diagram schematic of the adaptive feedforward approach used on a First fixture for mitigating DMA transients due to Vdm blip in an exemplary embodiment.

An exemplary block diagram schematic of the first approach is shown in FIG. 3. As shown in FIG. 3, the dynamics of the feedforward controller are defined by Equation (2).

$$V_{mag}^{ff}(t) = -aV_{mag}^{ff}(t),$$

$$V_{mag}^{ff}(t) = V^*, \text{if } v(t) = v^* \tag{2}$$

While the model structure given in Equation (2) was used for the particular case involving Fixture 1, it is envisioned that any number of models may be used, such as, for example, the model structure given in Equation (1).

According to Equation (2), the feedforward component of the magnetic roll voltage is set to V* at the time of a Vdm blip (a Vdm blip is denoted by v*). After the Vdm blip, the feedforward voltage decays exponentially with time constant "a". The motivation behind this structure is to select a feedforward voltage profile that will cancel the DMA transient induced by the Vdm blip (see FIG. 2). Because the initial boost in development following a Vdm blip changes over time, apparently as a function of the toner state, an adaptive algorithm to update V* is used. For this adaptive approach, the DMA is measured immediately after a blip and compared to the target value. If there is an error, then V* is updated for the next Vdm blip cycle. In this particular example, the most common parameter adaptation technique is equivalent to a PI control law, which is what has been implemented. It should be noted that other adaptive laws could be used as well as this example. In this example, the decay rate "a" is treated as fixed. However, "a" may be adapted as well.

To initialize V*, there are several options. If the machine has been running high throughout prior to a machine cycle-up, then the toner state is typically good and Vdm blip has a relatively small effect on development. Under these conditions V*=0 serves as a reasonable initialization. Otherwise, V* could be initialized during machine cycle-up.

Control Approach #2—Repetitive Control

Figure 4:
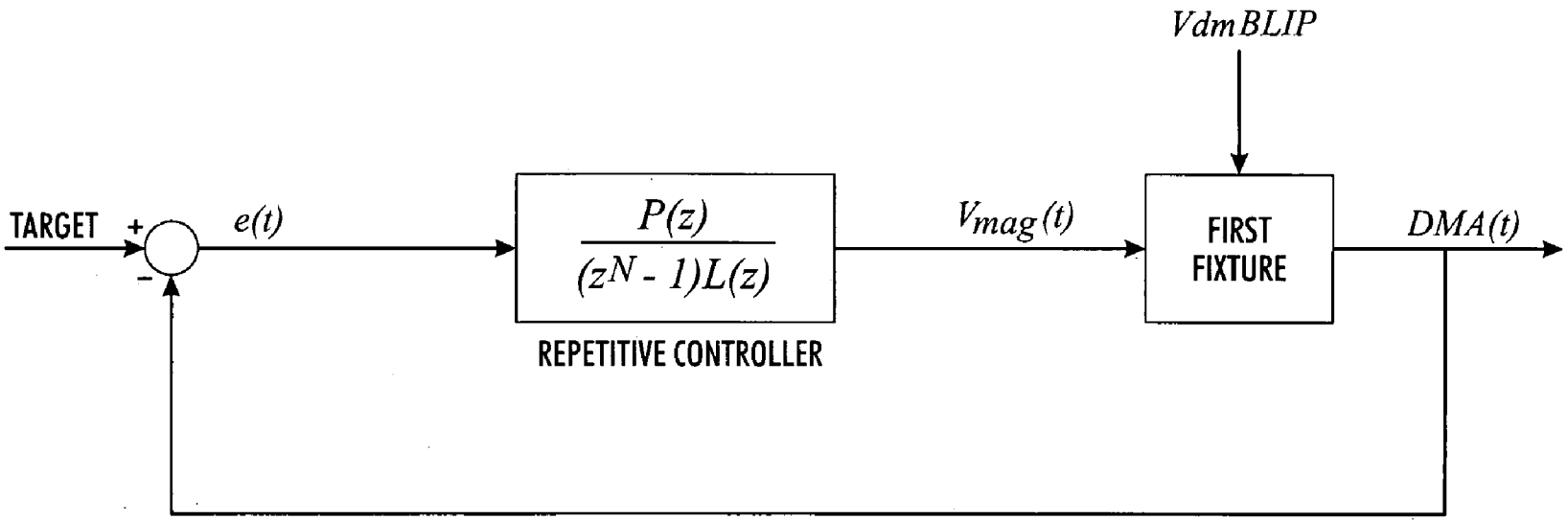
FIG. 4 is a block diagram schematic of the repetitive control approach used on a first fixture for mitigating DMA transients due to Vdm blip.

A block diagram representation of the second control strategy is shown in FIG. 4. This repetitive approach is intended for cases where maintenance occurs periodically. Whereas, the Control Approach #1 can be applied to any occasional maintenance. This strategy uses a repetitive control approach to accomplish the functions of anticipating and adapting to the effects of maintenance. In general, repetitive control refers to an approach for controlling systems subject to periodic disturbances wherein, the period of the disturbance may be known. For the example presented here, the disturbance occurs at a known, fixed frequency. On the other hand, the resulting DMA transients are not, strictly speaking, periodic. The transients do change over time as a function of the toner state.

Even though the system response to a Vdm blip changes over time, this happens slowly with respect to the blip frequency so that the system can be viewed as quasi-periodic, which, in practice, is a key condition for applying repetitive control. Repetitive control approaches explicitly use this periodic assumption by computing actuator values based on the current measured error and then applying these actuator values N time steps in the future, where N is the period of the disturbance. Repeating this process at each time step will, in principle, cancel the error since the error was assumed to be periodic. Mathematically speaking, repetitive controllers have the following transfer function structure:

$$C(z) = \frac{P(z)}{(z^N - 1)L(z)}. \tag{3}$$

C(z) refers to discrete-time transfer function representation of the controller. P(z) and L(z) are polynomials whose coefficients are control design parameters. These design parameters can be selected according to many standard methods, e.g., pole placement.

A potential drawback to this approach is that the disturbances with a long period (large value of N) result in a higher order controller. In such cases, the adaptive feedforward control approach may be more appropriate.

Figure 5:
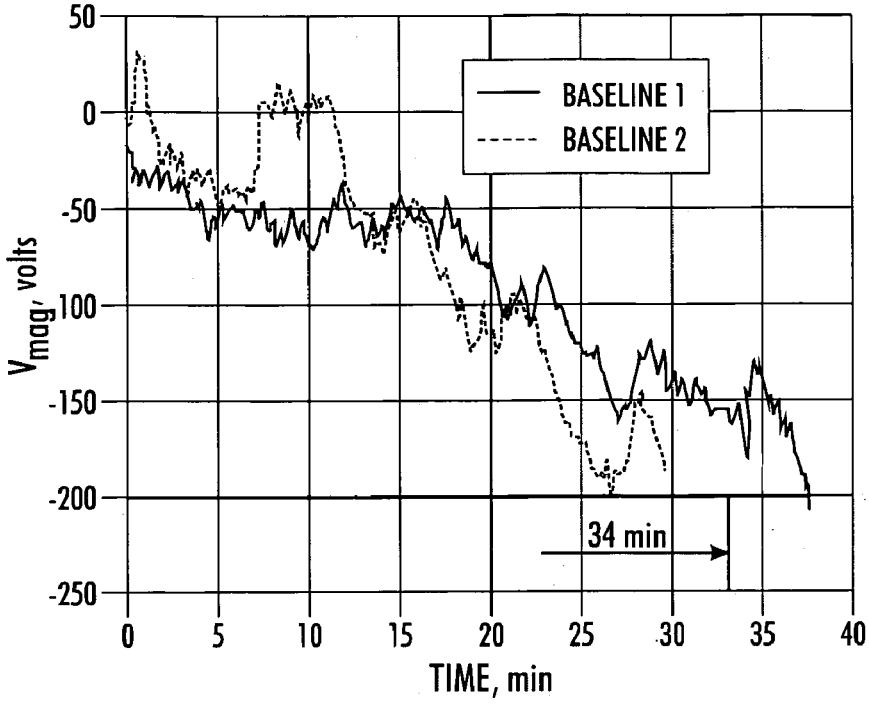
FIG. 5 is a chart that illustrates a Vmag response under baseline conditions in an exemplary embodiment.
Figure 6:
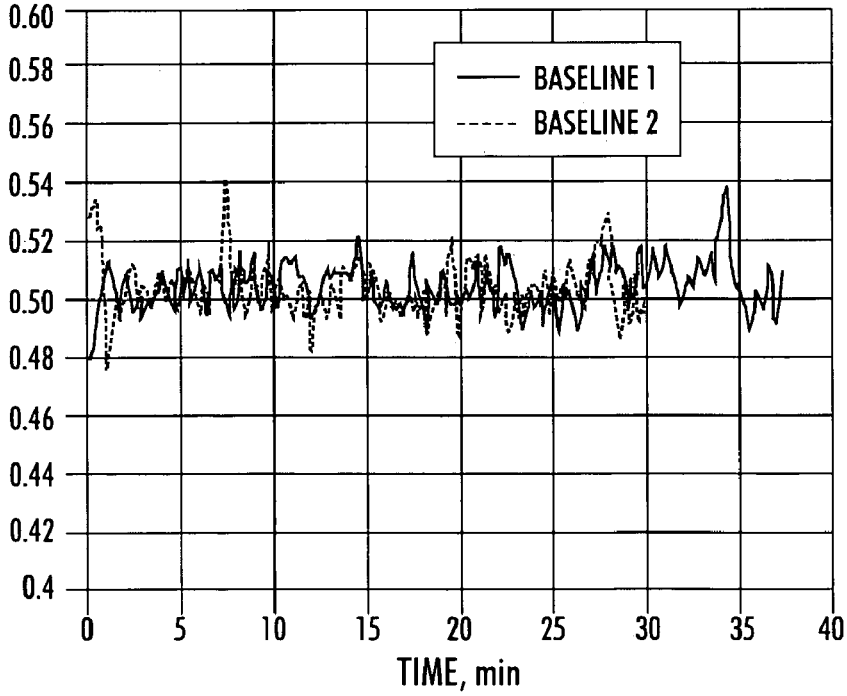
FIG. 6 is a chart that illustrates a DMA response under baseline conditions in an exemplary embodiment.

All of the experimental results were generated on the first fixture, where the control approaches were compared with baseline fixture operation. The baseline process controls included closed-loop DMA control (PI control) and closed-loop toner concentration control. The run conditions included low area coverage (less than 10%) in a dry environment (less than 30 GOW). Two key performance metrics that were tracked in the experiments were the time until the Vmag actuator reached a predetermined threshold and the DMA tracking performance. Prior to all experiments, the first fixture was initialized to a given state FIG. 5 shows examples of the Vmag actuator responses under baseline conditions (no Vdm blipping). Typically, Vmag reaches the threshold in about 34 minutes under baseline conditions. Also, a typical standard deviation in the DMA response is about $\sigma \cong 0.01$ mg/cm$^2$.

Figure 7:
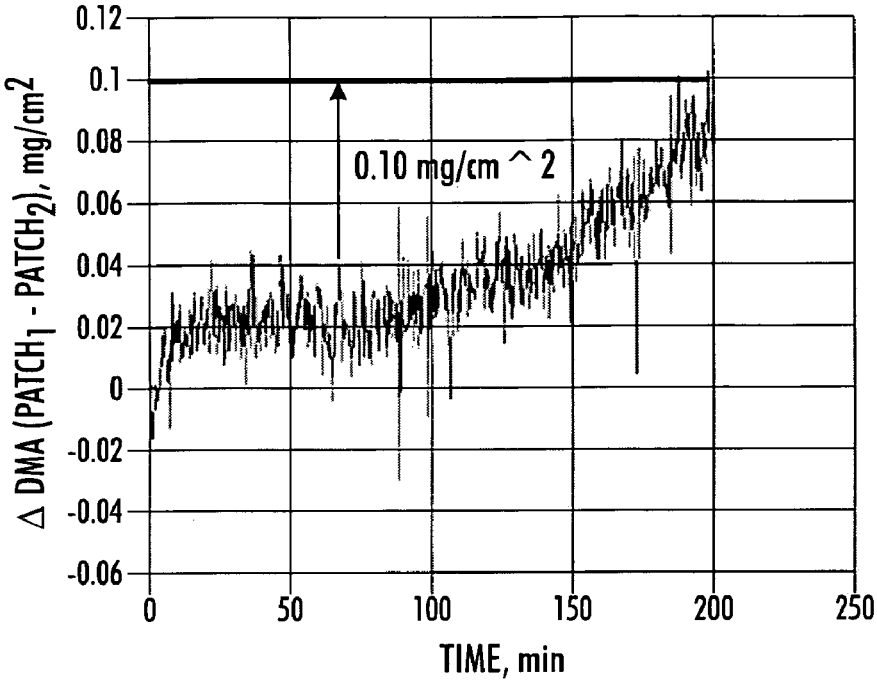
FIG. 7 is a chart that illustrates a time history of the DMA difference between a patch developed right after a Vdm blip and a patch developed right before a Vdm blip for the case where Vdm blip is used with the baseline DMA controller in an exemplary embodiment.

Next, the case where Vdm blip is used with in conjunction with the baseline PI controller for DMA control is considered. FIG. 7 shows the time history of the DMA difference between a patch developed right after a Vdm blip and a patch developed right before a Vdm blip. This difference becomes exceptionally large as the toner age increases, which highlights the coupling between Vdm blip and the process controls. This illustrates a limitation in the original Vdm blip concept that was observed by the sample printer.

Figure 8:
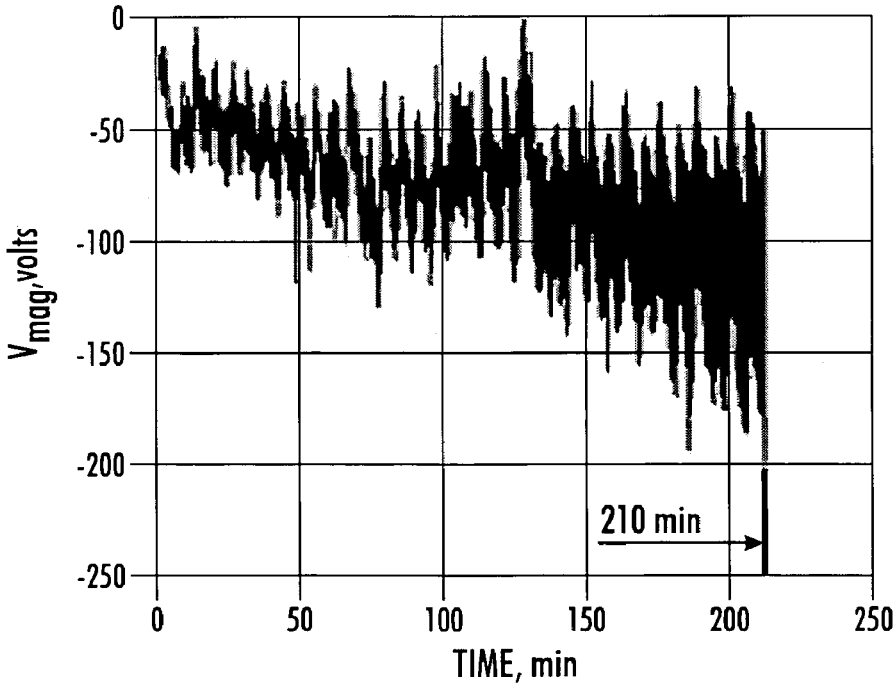
FIG. 8 is a chart that illustrates a Vmag response when Vdm blip is used with repetitive control in an exemplary embodiment.

The result of using Vdm blip in conjunction with the repetitive control approach under the baseline conditions is shown in FIG. 8. FIG. 8 has several key features. First, there are large, rapid changes in Vmag, which illustrates how the controller anticipates the effect of the Vdm blip. That is, before a Vdm blip development is relatively "poor" so the voltage required to achieve target DMA is relatively large. On the other hand, right after a Vdm blip development is relatively "good" so relatively less voltage is needed to achieve the target DMA. Second, FIG. 8 shows that swings in Vmag become larger over time, which indicates that the controller is adapting to the fact that the system is responding differently to the Vdm blip over time. Finally, FIG. 8 shows that the time to reach the Vmag threshold is 210 minutes, which represents about six times the improvement over the baseline performance. This illustrates the level of performance improvement realized by periodic donor/wire maintenance via Vdm blip.

Figure 9:
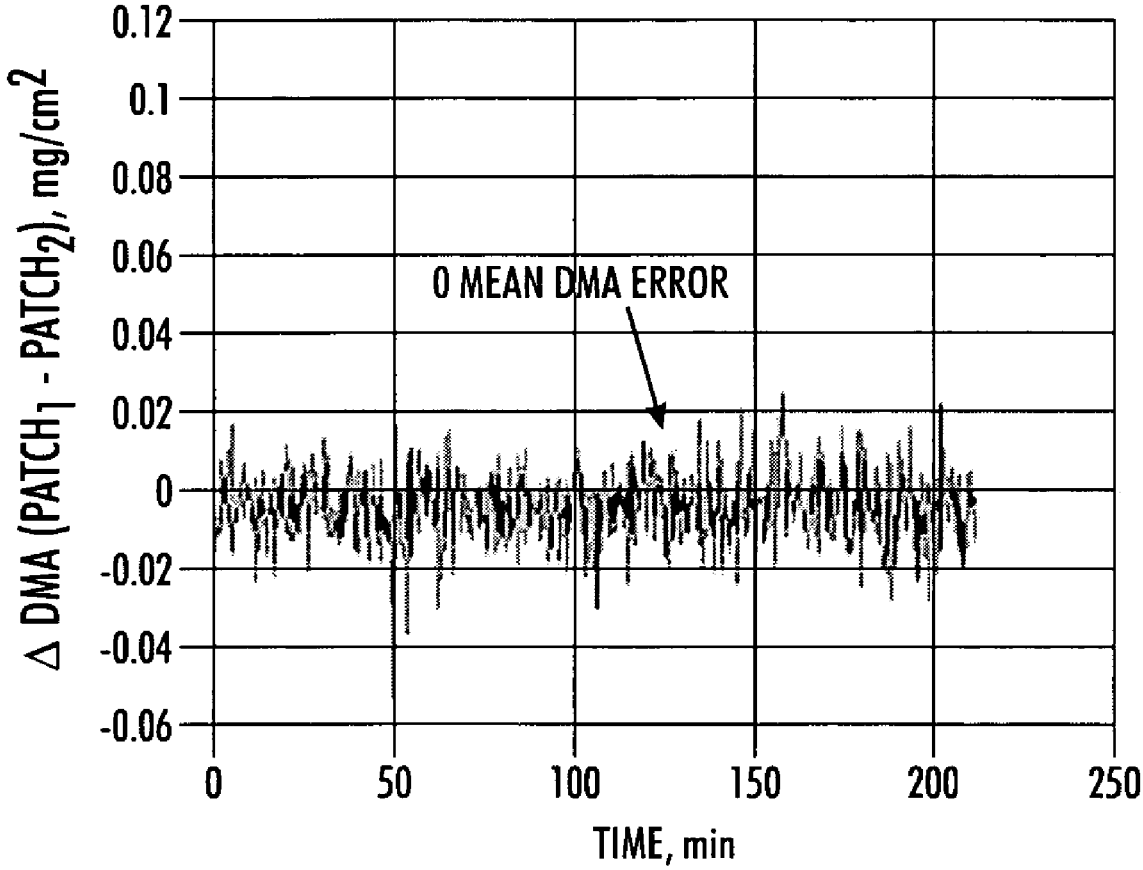
FIG. 9 is a chart that illustrates a time history of the DMA difference between a patch developed right after a Vdm blip and a patch developed right before a Vdm blip for the case where Vdm blip is used with repetitive control in an exemplary embodiment.

FIG. 9 shows the time history of the DMA difference between a patch developed right after a Vdm blip and a patch developed right before a Vdm blip for the case where Vdm blip is used with repetitive control. Whereas this difference grew over time when Vdm blip was used with the baseline DMA controller (see FIG. 7), FIG. 9 shows that when Vdm blip is used with repetitive control, this difference has 0 mean, indicating that, on average, the difference neither grew nor decreased over time. Moreover, the standard deviation of the DMA response for the repetitive control case was $\sigma \cong 0.01$ mg/cm$^2$, which is equivalent to the baseline DMA noise levels. In other words, the repetitive controller has eliminated the DMA transients typically associated with Vdm blip. Finally, we point out this example also serves to illustrate how adaptive feedback control can be used to enable periodic, on-line maintenance routines that would not be feasible to perform if carried out in isolation.

In an exemplary embodiment, a control scheme uses the above described adaptive fee-forward control routine to determine the appropriate Vmag, Vcharge and ROS intensity correction required to maintain a constant DMA and tone reproduction curve (TRC) between Vdm blip cycles.

Figure 10:
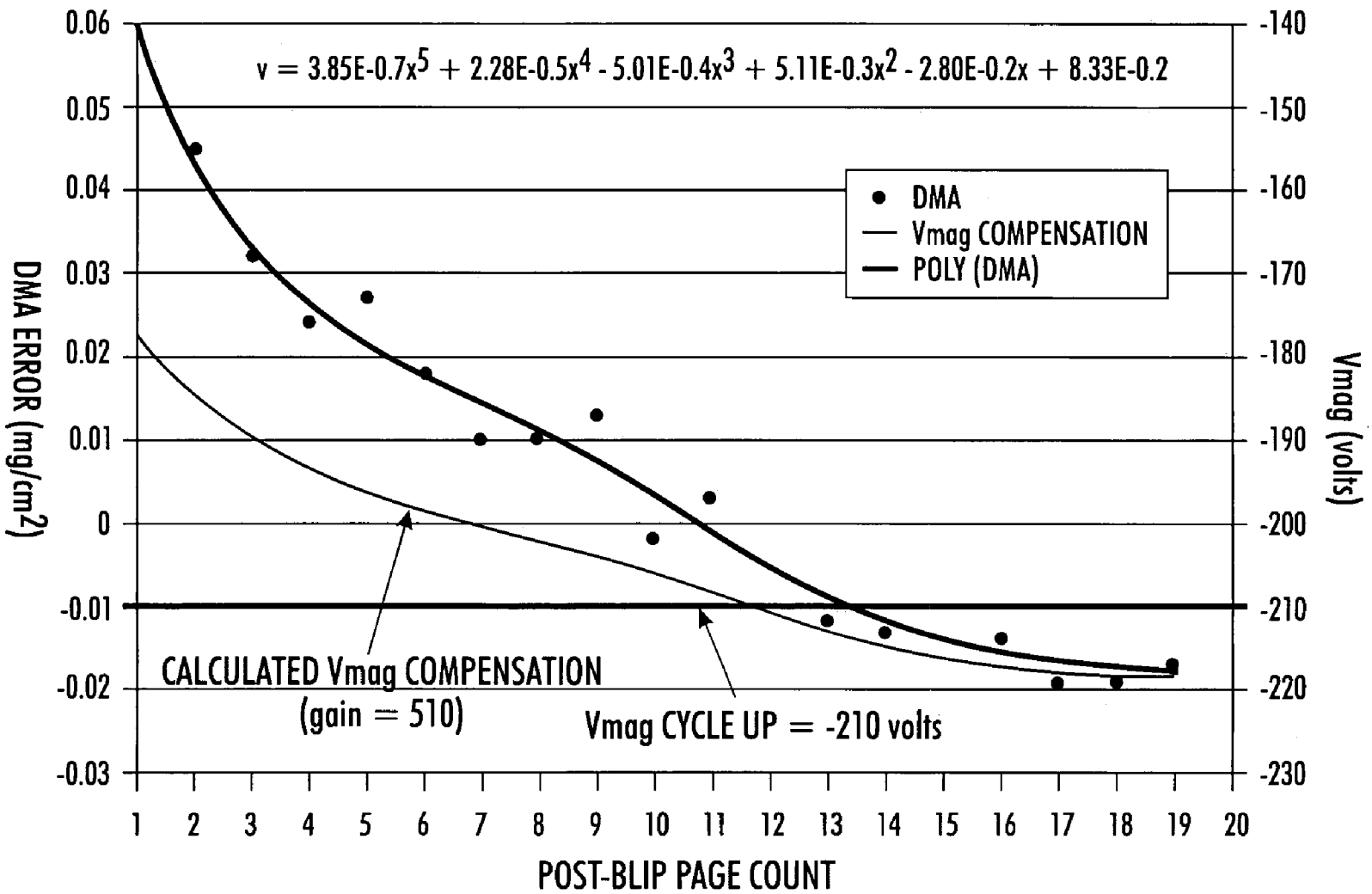
FIG. 10 is chart that illustrates an increase in DMA followed by a continuous decay to a steady state value, subsequent to a Vdm blip control in an exemplary embodiment.

With reference to FIG. 10, after the blip occurrence, DMA jumps above the specified set-point by 0.06 mg/cm$^2$, followed by a continuous decay to a level 0.02 mg/cm$^2$ below the specified set-point. That is, there is no change in the system except toner accumulating onto the wires. This transient results in unacceptable image quality performance. Thus, in order to mitigate the transient, the Xerographic control actuators must be varied to keep the xerographic process controlled in the presence of a Vdm blip disturbance.

There can be three or more actuators in a xerographic printing machine that may be used to keep the xerographic process in control. The magnetic roll bias, the photoreceptor charge level, and the ROS laser intensity are examples of such actuators. Each of these actuators may work independently. The magnetic roll bias typically controls the DMA, so, for example, if the magnetic roll bias is altered, a DMA transient may be mitigated.

For example, referring to FIG. 10, subsequent to a Vdm blip occurrence, while maintaining a constant Vmag, a step-function increase in DMA will be observed followed by a continuous decay to a steady state value. Similar transients are observed for specified tone reproduction curve set-points as well.

In order to eliminate these transients, the magnetic roll bias (Vmag), the photoreceptor charge biases, and the ROS laser intensity must be actively controlled between blip cycles to compensate for the transient induced by the Vdm blip maintenance routine. The proposed controller consists of two modes of operation, cycle-up convergence and maintenance. The cycle-up convergence mode will complete several iterations at cycle up allowing xerographic set point/Vdm blip transient mitigation convergence, while the maintenance mode will periodically adjust the Vdm Blip compensation to maintain xerographic set-point targets.

At machine cycle-up, the Vdm blip controller first analyzes the post-Vdm blip DMA response, while xerographic actuators remain constant, and computes the DMA error as a function of time from blip occurrence (DMAerror=DMAactual−DMAsetpoint). The DMA error as a function of time from blip response, DMAerror($t_{blip}$), is characterized with a n-order polynomial or stored in a look up table (LUT). Appropriate signal processing may require several post-blip DMA responses to be acquired before an accurate compensation can be determined and applied. The Vmag compensation required to mitigate the post-blip transient is simply equal to the pre-determined n-order polynomial or LUT entries multiplied by a gain factor. See FIG. 10. Subsequently, after a Vdm blip routine, Vmag would be varied according to the compensation profile to mitigate any DMA transients induced by the Vdm blip routine.

Multiple iterations of the controller may be necessary to completely eliminate the post-Vdm blip DMA transient during cycle-up convergence. Upon subsequent controller iterations the controller will determine the next Vmag compensation by multiplying the gain factor by the sum of the cumulative DMAerror($t_{blip}$) and current DMAerror($t_{blip}$). This is, in effect, an integral controller that uses the cumulative DMAerror($t_{blip}$) to control the Vmag post-blip compensation. Accordingly, a general n-order polynomial or LUT is utilized to describe the DMAerror($t_{blip}$) response. A developed prototype utilized a fifth order polynomial to characterize the temporal blip response.

The maintenance mode would work very similar to the cycle-up convergence mode only the period between compensation updates would be greater.

During cycle-up convergence, subsequent to, or in parallel with DMA convergence, tone reproduction curve transients must be compensated for in a similar fashion to the DMA compensation process. Similar to traditional xerographic process controls, Photoreceptor charge and ROS laser intensity can be utilized to mitigate the TRC variations induced by the Vdm blip cycle. However, Vdm blip disturbances require frequent updates to tone reproduction curve control between blip cycles.

Figure 11:
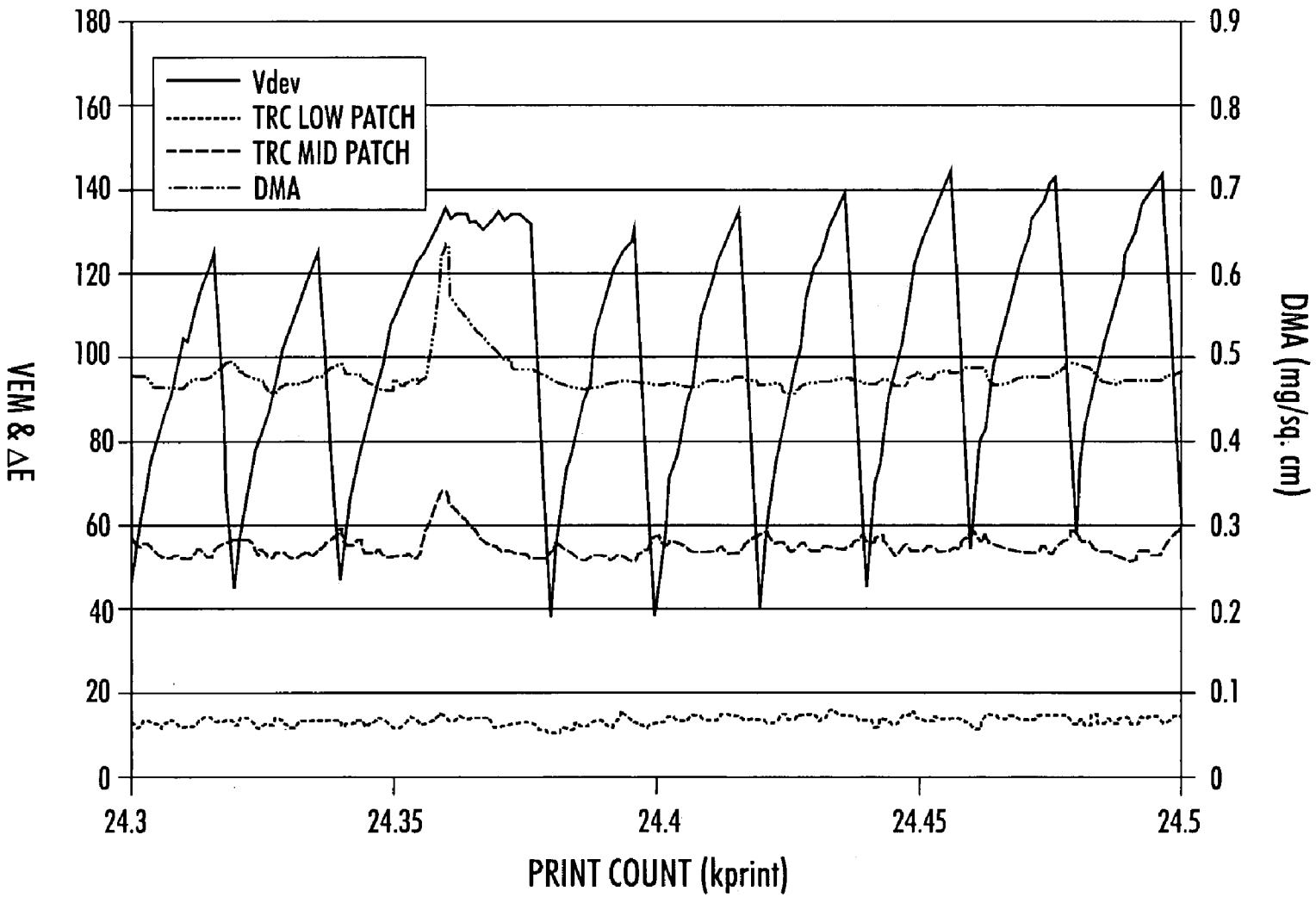
FIG. 11 is a chart illustrating DMA and TRC stability during a Vdm blip cycle with the adaptive Vdm blip control in an exemplary embodiment.
Figure 12:
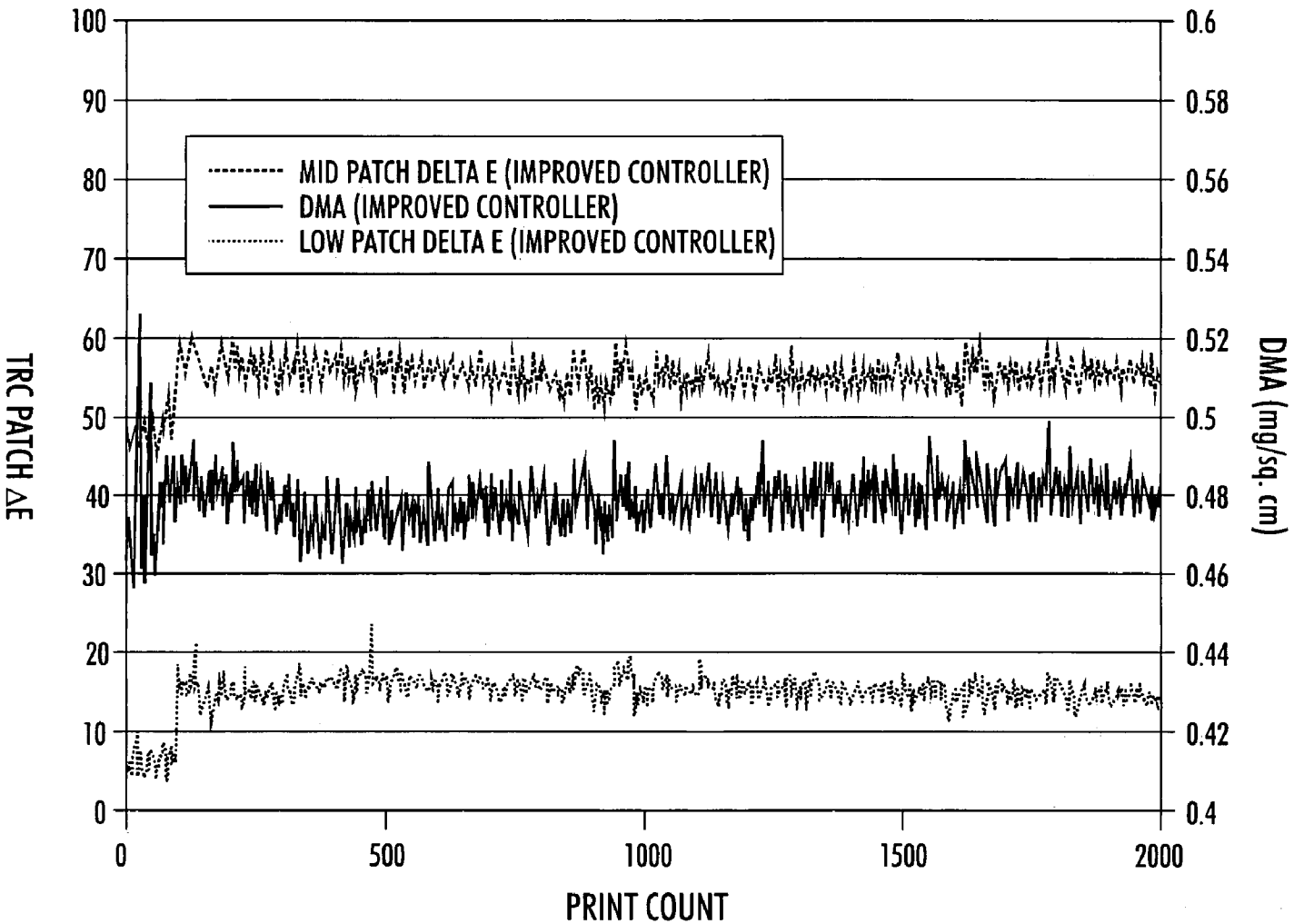
FIG. 12 is a chart illustrating DMA and TRC stability during a Vdm blip cycle without the adaptive Vdm blip control in an exemplary embodiment.

FIGS. 11 and 12 illustrate DMA and TRC stability during a Vdm blip cycle with and without the adaptive Vdm blip control.

The exemplary embodiments are not limited to the above-described examples, which are used here for illustrative purposes.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A control system for mitigating transients in machine performance due to periodic or occasional maintenance action taken on a machine, wherein the machine performance is evaluated based on process output variables, the system comprising:

a controller that monitors the process output variables indicative of the machine performance and adjusts machine inputs, including magnetic roll bias (Vmag), photoreceptor charge bias and ROS laser intensity, to achieve a desired level of machine performance, the controller monitors the process output variables indicative of the machine performance prior to, during, and immediately after the periodic or occasional maintenance action and adjusts the machine inputs to compensate for the transients in machine performance due to the maintenance action, and the controller operates under a cycle-up convergence mode and a maintenance mode, wherein the controller operates such that, in the cycle-up convergence mode, the controller completes one or more iterations at a cycle-up, allowing xerographic setpoint/Vdm blip transient mitigation convergence.

2. The control system of claim 1, wherein the controller operates such that, at the cycle-up, the controller analyzes a post-blip DMA (developed toner mass per unit area) response with a constant Vmag and computes a DMA error as a function of time from blip occurrence.

3. The control system of claim 2, wherein the DMA error is an actual measurement of the DMA subtracted by a setpoint DMA.

4. The control system of claim 3, wherein the controller operates such that, after a Vdm blip routine, the controller varies the Vmag to mitigate DMA transients induced by the blip routine.

5. The control system of claim 1, wherein the controller operates such that, during cycle-up convergence, subsequent to or in parallel with DMA convergence, the controller compensates tone reproduction curve transients.

6. The control system of claim 5, wherein the controller varies photoreceptor charge bias and ROS laser intensity to mitigate TRC (tone reproduction curve) variations induced by the Vdm blip cycle.

7. The control system of claim 6, wherein the controller updates Vcharge and ROS intensity between blip cycles.

8. A xerographic device, comprising:

the control system of claim 1.

9. A control system for mitigating transients in machine performance due to periodic or occasional maintenance action taken on a machine, wherein the machine performance is evaluated based on process output variables, the system comprising:

a controller that monitors the process output variables indicative of the machine performance and adjusts machine inputs, including magnetic roll bias (Vmag), photoreceptor charge bias and ROS laser intensity, to achieve a desired level of machine performance, the controller monitors the process output variables indicative of the machine performance prior to, during, and immediately after the periodic or occasional maintenance action and adjusts the machine inputs to compensate for the transients in machine performance due to the maintenance action, and the controller operates under a cycle-up convergence mode and a maintenance mode, wherein the controller operates such that, in the maintenance mode, the controller periodically adjusts Vdm Blip compensations to maintain xerographic set-point targets.

10. A method for mitigating transients in machine performance due to periodic or occasional maintenance action taken on a machine, wherein the machine performance is evaluated based on process output variables, the method comprising:

monitoring the process output variables indicative of the machine performance;

adjusting machine inputs to achieve a desired level of machine performance;

monitoring the process output variables indicative of the machine performance prior to, during, and immediately after the periodic or occasional maintenance action;

adjusting the machine inputs to compensate for the transients in machine performance due to the maintenance action;

operating the machine under a cycle-up convergence mode and a maintenance mode; and completing several iterations at a cycle-up, allowing xerographic setpoint/Vdm blip transient mitigation convergence, when in the cycle-up convergence mode.

11. The method of claim 10, further comprising:

analyzing a post-blip DMA (developed toner mass per unit area) response with constant xerographic actuators and computing a DMA error as a function of time from blip occurrence.

12. The method of claim 11, wherein the DMA error is an actual measurement of the DMA subtracted by a setpoint DMA.

13. The method of claim 12, further comprising:

varying Vmag (magnetic roll bias) after a Vdm blip routine to mitigate DMA transients induced by the blip routine.

14. The method of claim 10, further comprising:

compensating tone reproduction curve transients subsequent to or in parallel with DMA convergence.

15. The method of claim 14, further comprising:

varying photoreceptor charge biases and ROS laser intensity to mitigate TRC (tone reproduction curve) variations induced by the Vdm blip cycle.

16. The method of claim 15, wherein photoreceptor charge bias and ROS laser intensity are updated between blip cycles.

17. A method for mitigating transients in machine performance due to periodic or occasional maintenance action taken on a machine, wherein the machine performance is evaluated based on process output variables, the method comprising:

monitoring the process output variables indicative of the machine performance:

adjusting machine inputs to achieve a desired level of machine performance;

monitoring the process output variables indicative of the machine performance prior to, during, and immediately after the periodic or occasional maintenance action;

adjusting the machine inputs to compensate for the transients in machine performance due to the maintenance action;

operating the machine under a cycle-up convergence mode and a maintenance mode; and periodically adjusting Vdm Blip compensations in the maintenance mode, to maintain xerographic set-point targets.

* * * * *